US005129534A

United States Patent [19]

Dunn

[11] Patent Number: 5,129,534

[45] Date of Patent: Jul. 14, 1992

[54] COMPOSITE KEG

[75] Inventor: Martin T. Dunn, Hartsville, S.C.

[73] Assignee: Sonoco Products Company, Hartsville, S.C.

[21] Appl. No.: 737,083

[22] Filed: Jul. 29, 1991

[51] Int. Cl.[5] ..... B65D 6/24

[52] U.S. Cl. ..... 220/4.33; 220/4.11; 220/4.12

[58] Field of Search ..... 220/4.33, 4.09, 411, 220/412, 410, 408, 4.04

[56] References Cited

U.S. PATENT DOCUMENTS

| | | | |
|---|---|---|---|
| 110,232 | 12/1870 | Hanvey . | |
| 777,873 | 12/1904 | Weeks . | |
| 962,938 | 6/1910 | Brown . | |
| 1,011,445 | 12/1911 | Killion | 220/4.33 |
| 1,147,954 | 7/1915 | Lachman . | |
| 1,636,223 | 7/1927 | Freeman . | |
| 1,757,335 | 5/1930 | Robinson | 220/411 X |
| 2,558,322 | 6/1951 | Stine . | |
| 4,519,219 | 5/1985 | Prepodnik et al. | 220/411 X |
| 4,690,299 | 9/1987 | Cannon | 220/4.12 X |
| 4,901,885 | 2/1990 | Boots . | |
| 4,969,567 | 11/1990 | Rogers | 220/4.33 |

*Primary Examiner*—Stephen Marcus
*Assistant Examiner*—Paul A. Schwarz
*Attorney, Agent, or Firm*—Dennison, Meserole, Pollack & Scheiner

[57] ABSTRACT

A multiple component keg including a liquid tight bottle with top and bottom concavo-convex lids engaged with the upper and lower ends of the bottle and compressively retained thereagainst by tensioned metal straps. The bottle is surrounded by a tubular composite sleeve intimately engaged with the bottle and retained within facing mounting grooves on the top and bottom lids. The bottom lid provides a stable base for the keg.

16 Claims, 3 Drawing Sheets

COMPOSITE KEG

BACKGROUND OF THE INVENTION

The desirability of single use or one trip containers for liquid, and in particular carbonated beverages such as beer, has resulted in the development of kegs which, rather than being of the conventional one piece metal construction, are formed of multiple interrelated and relatively inexpensive components.

The components, selected so as to in combination provide both liquid tightness and structural integrity, sufficiently reduce the cost of the keg as to make it economically feasible to merely dispose of the keg after its single use.

An example of a particularly desirable single use keg is presented in U.S. Pat. No. 4,690,299, issued to David C. Cannon and commonly assigned with the present application. The container in this patent utilizes a continuous outer metal sleeve to which the upper and lower end caps are fixedly joined. The outer sleeve encloses a composite or paperboard inner body which in turn receives an internal liquid impervious bag.

SUMMARY OF THE INVENTION

The keg of the present invention, while containing the structural integrity required for storage and long distance shipping of beer and similar carbonated beverages, is so constructed, both with regard to the materials used and the assembly procedures required, as to make it practical to consider the keg as a disposable item after a single use.

In conjunction therewith, and as the keg is readily disassembled into its component parts, a recycling of selected ones of the components is possible. This will be particularly desirable with regard to the more expensive components, and those components which can be compactly packaged to present minimal bulk for return shipment to the point of keg assembly. This would, as an example, apply to the disc-like metal end caps or lids which may be formed of stainless steel.

The keg comprising the invention utilizes a liquid tight shape sustaining container or bottle preferably formed of polyethylene terephthalate (PET). Dished top and bottom lids or end caps overlie the slightly domed upper and lower ends of the bottle and closely conform thereto. The upper lid mounts an annular metal cuff, which both protectively encloses the valving mechanism mounted to the bottle, and provides appropriate hand holds. The lower lid defines a planar support base below the lower extremity of the bottle.

Both lids are vertically inwardly compressed against the bottle by elongate metal straps which also exert a radial inward force on the bottle at spaced points thereabout whereby both the lids and the straps reinforce the bottle and provide enhanced strength to withstand the internal pressure of the carbonated beverage.

A tubular outer sleeve or shell of composite paperboard material surrounds the bottle in intimate engagement with the continuous vertical side thereof, providing support and stacking strength for the bottle. This in turn allows, as one important aspect, use of the keg on a standard filling line of the type commonly used for the automated filling of conventional reusable metal kegs.

Additional objects and advantages will become apparent from the following detailed description of the construction and manner of use of the invention.

DESCRIPTION OF THE PREFERRED EMBODIMENT

Figure 1:
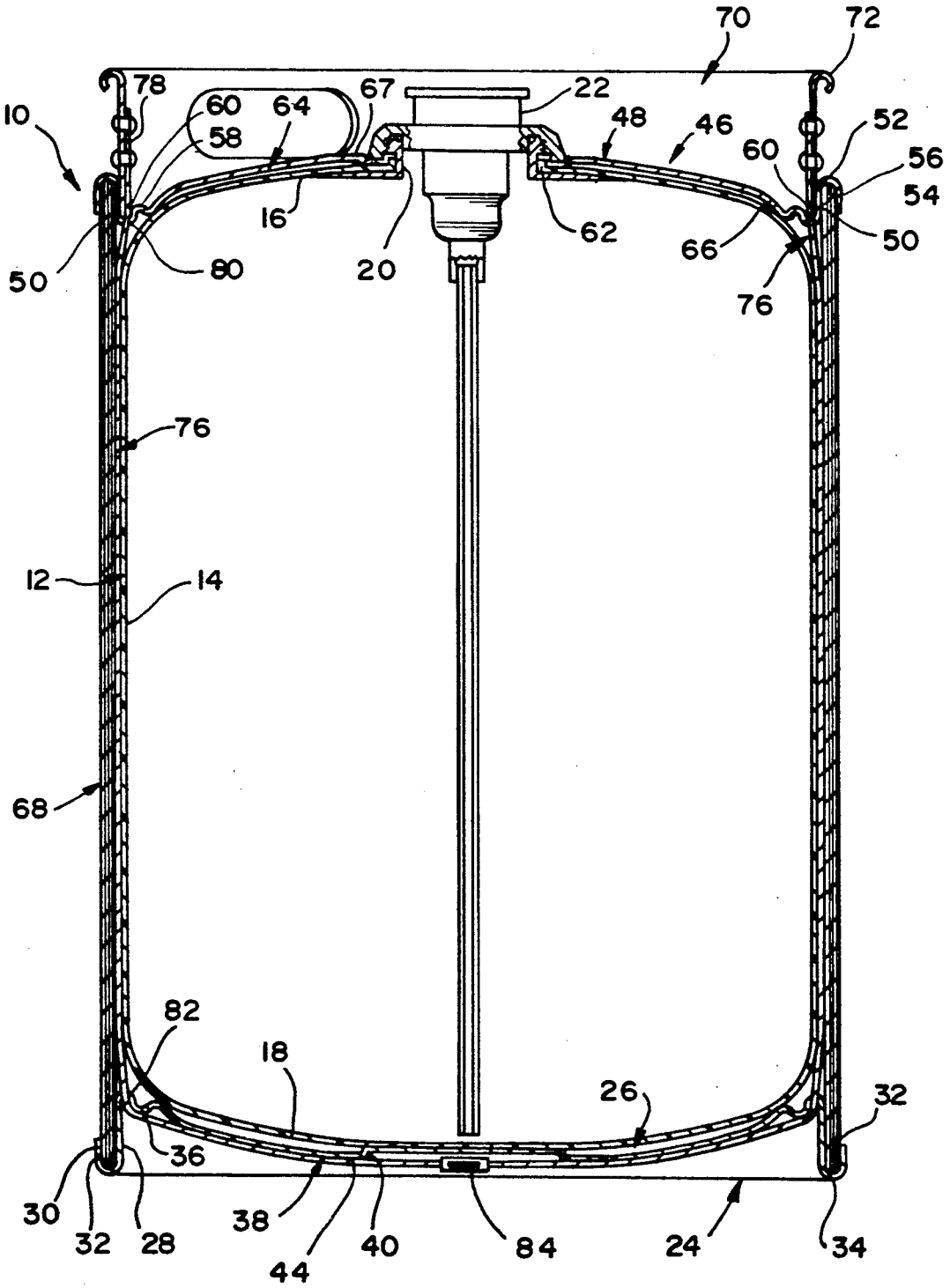
FIG. 1 is an enlarged vertical cross-sectional view, taken on a plane passing along line 1—1 in FIG. 2, of a multiple component keg for liquids constructed in accord with the present invention.
Figure 2:
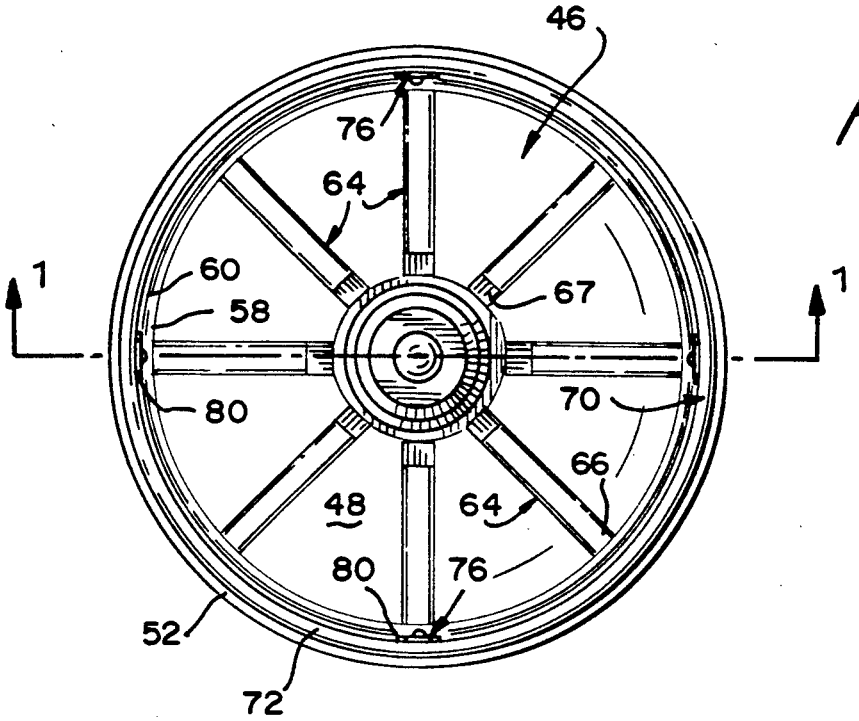
FIG. 2 is a top plan view of the keg.
Figure 3:
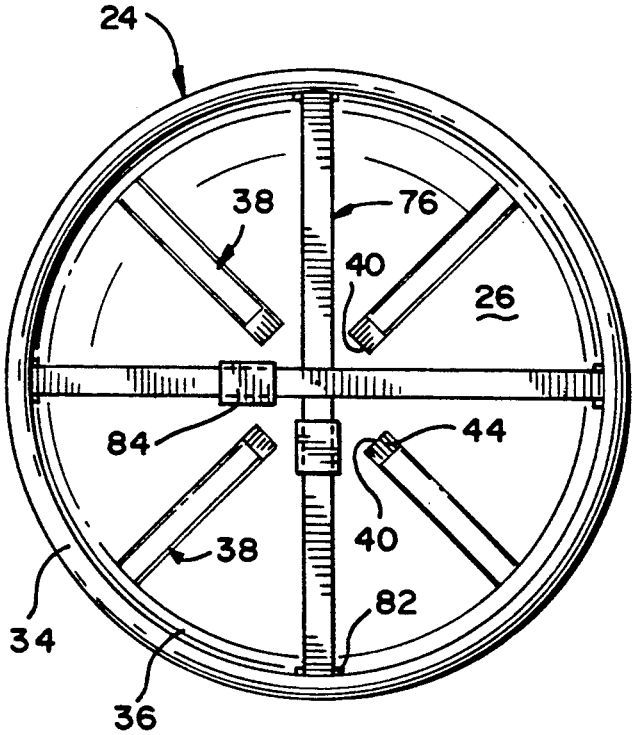
FIG. 3 is a bottom plan view of the keg.
Figure 4:
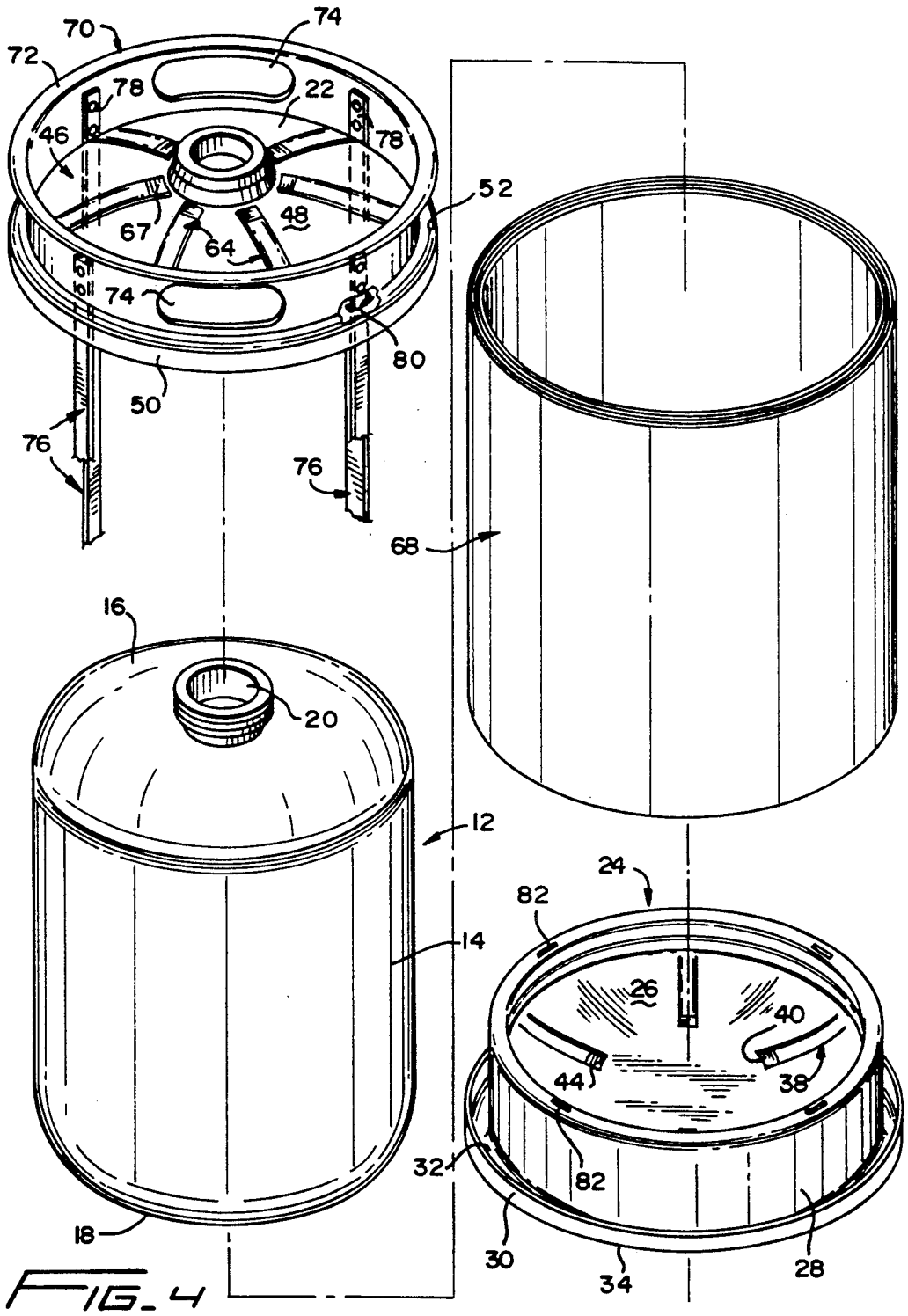
FIG. 4 is an exploded perspective view of the keg.

Referring now more specifically to the drawings, the beer keg, or more generally the bulk carbonated beverage container of the invention is designated by reference numeral 10. It is intended that the keg 10 be of a stable relatively high-strength construction capable of being filled, shipped, stored and otherwise used in the manner of a conventional beer keg. The keg herein differs from the conventional one piece metal keg in its construction of multiple low cost components structurally interrelated in a manner to achieve the desired strength and stability at a low cost allowing, as desired, use of the keg as a single-use item disposable after a dispensing of the liquid, or, alternatively, a recycling of selected components.

The keg 10 includes a liquid tight container or bottle 12 of an appropriate shape sustaining synthetic resinous material such as polyethylene terephthalate (PET). The bottle 12 includes a continuous cylindrical side wall 14 and slightly domed upper and lower ends 16 and 18. The upper end 16 has a central or axial flanged opening 20 formed therethrough and mounting a conventional dispensing valve assembly 22 for the introduction and subsequent discharge of liquid in the conventional manner.

A bottom lid or end cap 24 is formed of a single sheet of rigid high-strength metal, for example stainless steel, and includes a central section 26, comprising the major area of the bottom lid 24, which is of a concavo-convex or upwardly dished configuration closely conforming to and receiving the lower end 18 of the bottle 12. The bottom lid 24 includes a vertically depending peripheral flange 28 extending below the dished central section 26 and terminating in a reversely turned upwardly directed lip 30 substantially parallel to and outwardly spaced from the flange 28 annularly thereabout to define an annular upwardly directed mounting groove 32. The arcuate bend between the lower extremity of the flange 28 and the lip 30 defines a planar annular support line or surface 34 for a stable standing of the keg 10 in an obvious manner.

The bottom lid 24, in close inwardly spaced relation to the flange 28, includes an annular depression defining a depending annular reinforcing rib 36 between the dished central section 26 and the flange 28.

The dished central section 26 includes eight depending and radially extending reinforcing ribs 38 formed therefrom and positioned at equally spaced points thereabout. The radial ribs 38 extend outwardly from inner ends 40 on a circular line spaced outward from the center of the bottom lid 24 and extend to outer ends which taper to smoothly merge into the central section 26 immediately inward of the reinforcing rib 36. The ribs 38 are relatively wide, approximately 1 inch for a lid having a diameter of approximately 15.5 inches when providing a keg with a 30 liter capacity. The radial ribs 38, in cross-section, present planar outer faces which, while generally following the curvature of the lid, do include short horizontal extents or flats 44 adjacent the inner ends 40 thereof.

The domed upper end 16 of the bottle 12 receives a top lid or end cap 46 thereover. The top lid 46 is configured quite similar to the lower lid 24 and includes an upwardly dished or concavo-convex central section 48 which closely conforms to the generally domed configuration of the upper end 16 of the bottle 12. The central section 48 is surrounded by a vertical upwardly extending peripheral flange 50 terminating in a reverse bend defining an upper extremity 52 in a plane below the upper extremity of the central section 48. The reverse bend at the upward extremity 52 forms a depending lip 54 peripherally about the flange 50 in outwardly spaced relation thereto so as to define a downwardly directed mounting groove 56 vertically aligned with the upwardly directed annular groove 32 of the bottom lid 24.

An annular depression in the top lid 46 between the central section 48 and the peripheral flange 50 forms an integral upwardly directed annular reinforcing rib 58 radially inward of the flange 50 and defines an upwardly directed annular groove 60 therebetween.

A central opening surrounded by a short upstanding flange 62 is provided through the dished central section 48 for the accommodation and mounting of the valve assembly 22 in any appropriate manner. Eight radially elongate reinforcing ribs 64 extend outwardly from the valve accommodating central portion at equally spaced points thereabout and generally follow the curvature of the central section 48, terminating in outer end portions 66 which taper to meet the central section 48 immediately inward of the annular reinforcing rib 58. These ribs 64 are of the same size and configuration as the ribs 38 of the bottom lid 24 and are relatively wide, flat in cross-section, and include a flat linear extent 67 immediately adjacent their inner ends.

A rigid composite tubular sleeve 68, preferably formed of multiple spirally wrapped plies of paperboard or the like, is provided in intimate peripheral engagement with the peripheral wall 14 of the body 12 for substantially the full height thereof between the domed upper and lower ends 16 and 18. The upper and lower end portions of the tubular sleeve 68 are closely received and confined within the annular downwardly directed mounting groove 56 of the top lid and the annular upwardly directed mounting groove 32 of the bottom lid. As will be recognized, the outer peripheral flanges 28 and 50 of the bottom and top lids 24 and 46 vertically align with the vertical wall 14 of the bottle 12, thus insuring an intimate engagement of the tubular sleeve 68 with the bottle when the upper and lower end portions of the sleeve 68 are retained in close tolerance within the corresponding upper and lower mounting grooves 56 and 32.

An annular cuff 70, formed of sheet metal and including an outwardly rolled upper edge 72, has the lower portion thereof received within the upwardly directed annular groove 60 of the top lid 46 immediately adjacent the outer peripheral flange 50. The cuff 70, which may be fixed to the flange 50 by welding or the like, projects to a height greater than that of the valve assembly 22 in order to provide a protective wall thereabout. Further, in order to assist in the handling of the keg, appropriate hand holds 74 can be provided at selected points about and through the cuff 70.

The entire assembly of components is secured into a unitary construction by means of multiple, preferably two, sets of metal binding straps equally spaced about the circumference of the keg. Each set of straps includes two straps 76 having upper end portions 78 bolted, riveted, welded or otherwise affixed to the inner face of the cuff 70 at diametrically opposed points. Each strap depends from the affixed upper end through a slot 80 in the top lid 46 immediately adjacent the lower end of the cuff 70 between the peripheral flange 50 and the annular reinforcing rib 58.

The straps extend downward from the upper lid 46 between the peripheral wall 14 of the bottle 12 and the surrounding paperboard sleeve 68 and through aligned slots 82 in the bottom lid 24 between the peripheral flange 28 and the annular reinforcing rib 36.

The free lower ends of the two straps 76 of the set of straps are then engaged, the straps tensioned, and the lower ends interlocked, for example by utilizing a standard strapping tool which both tensions the straps and applies an appropriate seal 84, by crimping, to the overlapped strap ends.

The straps of each set are positioned to overlie a pair of diametrically aligned bottom reinforcing ribs 38, engaging the flat outer surfaces thereof along substantially the entire length of the ribs. Thus positioned, a proper alignment of the sets of straps relative to each other is assured, and a slight spacing provided for accommodating the sealed or crimp-joined lower ends of the straps centrally of the bottom lid 24. When two sets of straps are utilized, as is preferred, the two sets will be oriented at right angles to each other as illustrated.

While the straps 76 engage the bottle 12 between the bottle and the surrounding sleeve 68, the straps are quite thin, providing the desired tensile strength and lateral stability without interfering with the intimate contact of the sleeve 68 with the bottle peripheral wall 14. Further, and in noting FIG. 1 in particular, the upper and lower slots in the top and bottom lids through which the straps 76 extend are slightly radially inward relative to the outer peripheral flanges 50 and 28, and slightly radially inward of the outer vertical surface of the peripheral wall 14 of the bottle 12 whereby a tensioning of the straps produces an inward compressive force on the side wall of the bottle for an enhanced stabilization and rigidification thereof against internally generated pressures. The upper and lower domed ends of the bottle are similarly rigidified and strengthened by the vertical compressive loads on the overlying and underlying top and bottom lids.

While the cuff 70 may be affixed to the outer peripheral flange 50 of the top lid 46, such an actual securement may not be necessary in that the cuff 70 will be effectively retained and will appropriately downwardly clamp against the top lid 46 upon a tensioning of the metal straps 76.

The keg, as thus formed, utilizes inexpensive components interrelated in a unique manner to achieve the structural integrity required for a carbonated beverage container. The top and bottom lids and the tensioned metal straps provide structural rigidity resisting internally generated pressure. Additional stability is provided by the intimately engaged surrounding paperboard sleeve 68 which provides support for the liquid containing bottle, stacking strength, cushioning and protection for the exterior of the bottle, and the requisite stability to enable an accommodation of the keg on a conventional filling line.

After the beverage has been dispensed, also in a conventional manner utilizing the valve assembly, the keg is easily disassembled into its component parts by a cutting of the metal straps. The components can then be disposed of or recycled as deemed most economically desirable. For example, rather than return the bulky bottles, which would have to be re-sterilized for reuse, it is more likely that the inexpensive bottles will merely be disposed of. By the same token, the relatively more expensive top and bottom lids, because of their generally flat nature, can be easily packaged and return shipped for reuse. As these lids are external of and out of contact with the liquid, no re-sterilization expenses will be involved.

The foregoing is considered illustrative of the principals of the invention, and as variations and modifications may occur to those skilled in the art, it is to be appreciated that the invention is to only be limited by the scope of the claims following hereinafter.

What is claimed is:

1. A multiple component keg for carbonated beverages and the like including a self-supporting liquid tight container with upper and lower ends, a rigid top lid and a rigid bottom lid respectively overlying and underlying said upper and lower ends of said container, a tubular paperboard sleeve encircling said container and in confining engagement therewith, said sleeve having upper and lower ends respectively engaged and retained by said top and bottom lids, elongate strap means extending between said top and bottom lids and retaining said top and bottom lids respectively against said upper and lower ends of said container and in retaining engagement with said upper and lower ends of said sleeve, said bottom lid comprising a central section configured to conform to said lower end of said container and a peripheral flange integral with and depending below said central section and forming a lower edge defining a support surface, said flange at said lower edge, being reversely turned and forming an upwardly extending lip outwardly spaced from said flange and defining therewith an upwardly directed groove mounting said lower end of said sleeve, said bottom lid including a peripheral reinforcing rib defined therein between said central section and said peripheral flange, said top lid comprising a central section configured to conform to said upper end of said container and a peripheral flange integral with and extending vertically upward peripherally about said top lid central section, said top lid peripheral flange terminating in a reversely turned upper edge defining a downwardly extending lip outwardly spaced from said upwardly extending flange and defining therewith a downwardly directed groove mounting said upper end of said sleeve, a rigid cuff overlying said top lid immediately inward of said top lid peripheral flange, said cuff extending vertically above said central section of said top lid and defining a protective enclosure therefor, said top lid including a peripheral reinforcing rib formed therein in inwardly spaced relation to said top lid flange and defining therebetween an upwardly directed annular groove receiving said cuff, said elongate strap means comprising at least one set of straps including two straps at generally diametrically opposed portions of said keg, said straps having upper ends fixed to said cuff, said top and bottom lids having aligned slots vertically therethrough and in alignment with the secured upper ends of said straps, said straps extending vertically through said aligned slots and terminating in lower end portions below said central section of said bottom lid, and means interconnecting said lower end portions of said straps and retaining said straps under tension whereby a compressive force is exerted against said lids and said container therebetween.

2. The keg of claim 1 wherein said slots in said top and bottom lids are positioned slightly radially inward relative to the exterior of said container whereby said tensioned straps exert a radial inwardly directed force on said container for resistance of internally generated pressure within said container.

3. The keg of claim 2 including downwardly directed radial ribs integrally defined in said bottom lid, at least two of said radial ribs being diametrically opposed and receiving said straps of said set of straps therealong.

4. The keg of claim 3 including at least two sets of straps oriented generally at right angles to each other.

5. A multiple component keg for carbonated beverages and the like including a self-supporting liquid tight container with upper and lower ends, a rigid top lid and a rigid bottom lid respectively overlying and underlying said upper and lower ends of said container, a tubular paperboard sleeve encircling said container and in confining engagement therewith, said sleeve having upper and lower ends respectively engaged and retained by said top and bottom lids, and elongate strap means extending between said top and bottom lids and retaining said top and bottom lids respectively against said upper and lower ends of said container and in retaining engagement with said upper and lower ends of said sleeve, said bottom lid comprising a central section configured to conform to said lower end of said container and a peripheral flange integral with and depending below said central section and forming a lower edge defining a support surface, said top lid comprising a central section configured to conform to said upper end of said container, said top lid including a peripheral upwardly directed flange surrounding said central section of said top lid, an annular rigid cuff overlying said top lid immediately inward of said peripheral flange thereof, said strap means comprising two pairs of diagonally aligned straps, each pair of straps being at approximately right angles to the other pair of straps, each of said straps having an upper end portion fixed to said cuff, said straps of each pair extending downwardly from said cuff in engagement with said container inward of said sleeve and terminating in lower end portions underlying said bottom lid, and connector means retaining said lower end portions of the straps of each pair in interlocked engagement with each other under tension.

6. The keg of claim 5 wherein said top and bottom lids include a pair of vertically aligned slots therein aligned with and receiving each strap, said slots being slightly radially inward relative to the exterior of said container whereby a radial inward force is exerted on said container.

7. The keg of claim 6 wherein said top and bottom lids include integral peripheral lips immediately outward of the respective peripheral flanges thereof and respectively defining a downwardly directed retaining groove on said top lid and an upwardly directed retaining groove on said bottom lid, said retaining grooves receiving said upper and lower ends of said sleeve.

8. A multiple component keg for carbonated beverages and the like including a shape sustaining liquid tight container with upper and lower ends, a rigid top lid and a rigid bottom lid respectively overlying and underlying said upper and lower ends of said container, a sleeve encircling said container and in confining engagement therewith, said sleeve having upper and lower ends, said top and bottom lids engaging and retaining said upper and lower ends of said sleeve, and means engaging said top and bottom lids and retaining said top and bottom lids in compression respectively against said upper and lower ends of said container against any tendency of said container to expand as a result of internally generated pressures, said means engaging said top and bottom lids comprising at least two pairs of diametrically opposed tensioning straps with the straps of each pair having upper end portions fixed relative to said top lid, and lower end portions underlying said bottom lid, and means interlocking said lower end portions of each pair of straps under tension.

9. The keg of claim 8 wherein said straps engage said container and exert a radial inward force thereagainst for resistance of internally generated pressure.

10. The keg of claim 9 wherein said straps are positioned inward of said sleeve.

11. The keg of claim 10 wherein said sleeve is of a shape-sustaining composite construction.

12. The keg of claim 11 wherein said top lid and said bottom lid respectively include a downwardly directed peripheral groove and an upwardly directed peripheral groove respectively receiving and retaining said upper and lower ends of said sleeve.

13. A multiple component keg for carbonated beverages and the like including a shape sustaining liquid tight container with upper and lower ends, a rigid top lid and a rigid bottom lid respectively overlying and underlying said upper and lower ends of said container, a sleeve encircling said container and in confining engagement therewith, said sleeve having upper and lower ends, said top and bottom lids engaging and retaining said upper and lower ends of said sleeve, and means engaging said top and bottom lids and retaining said top and bottom lids in compression respectively against said upper and lower ends of said container against any tendency of said container to expand as a result of internally generated pressures, said means engaging said top and bottom lids comprising at least one pair of diametrically opposed tensioning straps having upper end portions fixed relative to said top lid, and lower end portions underlying said bottom lid, and means interlocking said lower end portions of said at least one pair of straps under tension.

14. The keg of claim 13 wherein said straps engage said container and exert a radial inward force thereagainst for resistance of internally generated pressure.

15. The keg of claim 14 wherein said straps are positioned inward of said sleeve.

16. The keg of claim 15 wherein said sleeve is of a shape-sustaining composite construction.

* * * * *